United States Patent [19]

Bell, III et al.

[11] 4,404,806

[45] Sep. 20, 1983

[54] GAS TURBINE PRECHAMBER AND FUEL MANIFOLD STRUCTURE

[75] Inventors: Albert H. Bell, III, Birmingham; James C. Hyde, Sterling Heights, both of Mich.

[73] Assignee: General Motors Corporation, Detroit, Mich.

[21] Appl. No.: 299,630

[22] Filed: Sep. 4, 1981

[51] Int. Cl.[3] ..... F02C 7/22

[52] U.S. Cl. ..... 60/737; 60/743; 60/746

[58] Field of Search ..... 60/734, 737, 740, 742, 60/743, 748, 39.09 F-39.094, 746

[56] References Cited

U.S. PATENT DOCUMENTS

| | | | |
|---|---|---|---|
| 2,646,664 | 7/1953 | Meschiro | 60/743 X |
| 3,016,705 | 1/1962 | Kneidl et al. | 60/39.09 F |
| 3,483,699 | 12/1969 | Harvey | 60/737 |
| 3,748,853 | 7/1973 | Jones et al. | 60/737 |

*Primary Examiner*—Louis J. Casaregola

*Assistant Examiner*—Timothy S. Thorpe

*Attorney, Agent, or Firm*—Saul Schwartz

[57] ABSTRACT

An improved prechamber and fuel manifold structure for a gas turbine engine having a premixing-prevaporizing type combustor, the improvement residing in the provision of a prechamber having an internal cylindrical surface swept by swirling pressurized air passing through the prechamber from a plenum to the combustor and in the provision of a fuel manifold having a plurality of individual fuel conduits extending from a remote fuel supply pipe to a corresponding plurality of delivery heads in the prechamber. The delivery heads direct fuel generally tangent to the internal cylindrical surface to form a film for vaporization in the passing air and the length of the fuel conduits and the flow areas of the fuel conduits and the delivery heads are generally equal so that fuel flow in the fuel conduits is balanced and so that when the conduits are opened to atmospheric pressure at termination of combustion, purging of residual fuel to foreclose coking is rapid and complete.

3 Claims, 3 Drawing Figures

GAS TURBINE PRECHAMBER AND FUEL MANIFOLD STRUCTURE

BACKGROUND OF THE INVENTION

This invention relates generally to gas turbine engine fuel systems and, more particularly, to an improved prechamber and fuel manifold structure for gas turbine engines having premix-prevaporization type combustors.

In premixing-prevaporization type gas turbine engine combustors fuel is introduced into a prechamber ahead of the combustor reaction chamber in which prechamber it vaporizes in and mixes with a controlled quantity of pressurized air flowing through the prechamber to the reaction chamber. The subsequent combustion reaction which occurs in the combustor reaction chamber is characterized, at least in part, by the air-fuel ratio of the mixture formed in the prechamber so that by tailoring the air-fuel ratio the combustion reaction itself can, to varying degrees, be tailored. The degree of success achieved in tailoring the air-fuel ratio depends, again at least in part, on the ability of the fuel manifold to deliver precisely metered quantities of fuel to the prechamber and then on the ability of the prechamber to effect efficient vaporization and mixtures of the fuel. In one prior design, efficient fuel vaporization is promoted by multiple fuel delivery heads spraying or otherwise introducing fuel generally into the center of a prechamber through small metering orifices connected to larger fuel manifolds. In another proposal, fuel is injected into a cylindrical prechamber generally tangent to a wall of the prechamber and is immediately separated from the wall and atomized by air passing through the chamber. In still another proposal, a large number of swirl cans are disposed around an annular combustor, each swirl can having a fuel line extending from a remote manifold and delivering fuel generally tangent to a cylindrical surface of the swirl can. A prechamber and fuel manifold structure according to this invention represents an improvement over these and other known prechamber and fuel manifold structures.

SUMMARY OF THE INVENTION

The primary feature, then, of this invention is that it provides an improved prechamber and fuel manifold structure for a gas turbine engine having a premixing-prevaporizing type combustor. Another feature of this invention resides in the provision in the improved prechamber and fuel manifold structure of means for promoting efficient mixing and vaporization of the fuel and air and for effecting rapid and complete purging of residual fuel upon engine shut-down. Yet another feature of this invention resides in the provision in the improved prechamber and fuel manifold structure of simple and effective means for assuring even fuel flow at very low mass flow rates. A still further feature of this invention resides in the provision in the improved prechamber and fuel manifold structure of a generally cylindrical surface in the prechamber and a plurality of fuel delivery heads adapted to direct fuel generally tangent to the cylindrical surface to promote efficient vaporization of the fuel in air passing through the prechamber, the fuel delivery heads being supplied by separate, equal length fuel delivery conduit extending from a fuel source remote from the prechamber and having cross-sectional flow areas generally equal to the flow area of the delivery head so that fuel delivery is equal in each conduit and so that fuel is purged rapidly and completely from the delivery conduits upon engine shut-down. These and other features of this invention will be readily apparent from the following specification and from the drawings wherein:

Figure 1:
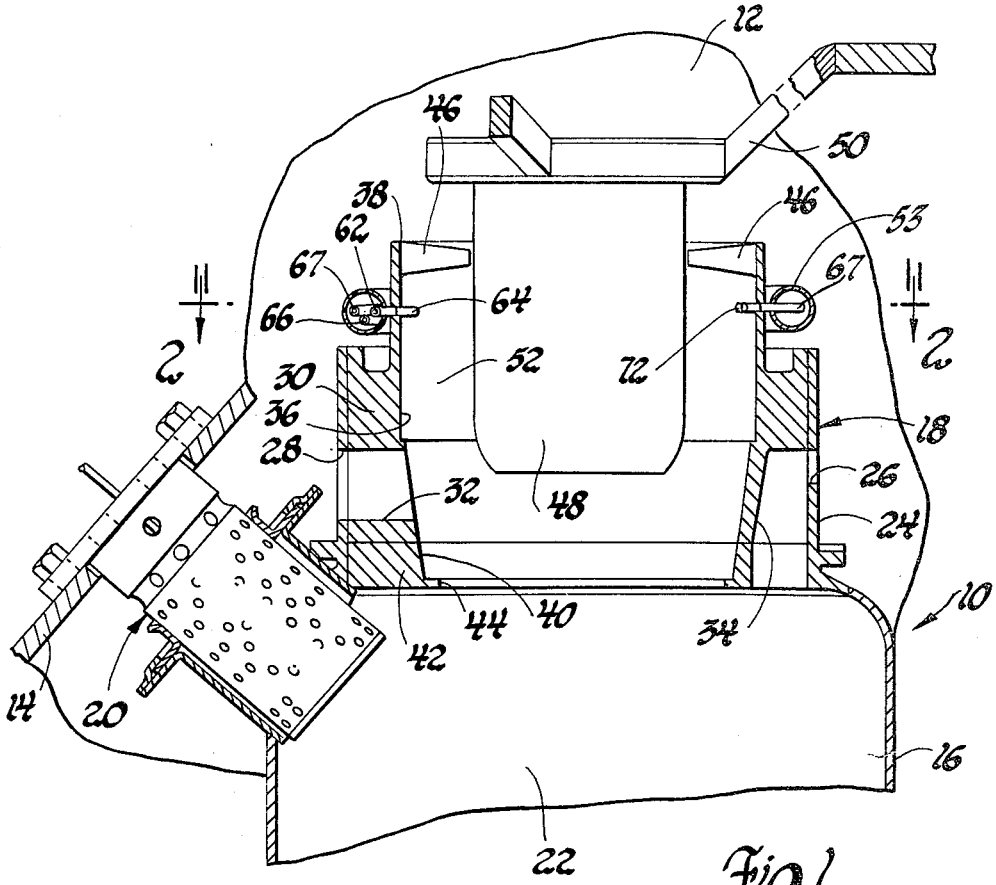
FIG. 1 is a fragmentary sectional view of a gas turbine engine premixing-prevaporization type combustor having an improved prechamber and fuel manifold structure according to this invention.

Referring now to FIG. 1 of the drawings, a premixing-prevaporizing type gas turbine engine combustor designated generally 10 having an improved prechamber and fuel manifold according to this invention is shown disposed in a pressurized air plenum 12 formed around the combustor by the casing of the gas turbine engine, a portion of the casing being indicated at 14. In conventional manner, the plenum 12 is supplied with pressurized air from the compressor, not shown, of the gas turbine engine which pressurized air may or may not be regeneratively heated. The combustor 10 includes a main body portion 16 and a premixing-prevaporizing portion 18. The main body portion 16 is generally cylindrical in configuration and supports, at the upper portion thereof, a flame tube assembly 20 projecting into a reaction chamber 22 defined within the main body portion. The flame tube assembly 20 is rigidly attached to the engine casing portion 14 by conventional means. For a full and complete description of a representative flame tube assembly 20, reference may be made to U.S. Pat. No. 4,141,213 issued Feb. 27, 1979 in the name of Phillip T. Ross and assigned to the assignee of this invention.

Referring again to FIG. 1, the premixing-prevaporizing portion 18 includes a generally cylindrical outer liner 24 integral with main body portion 16, the outer liner having a pair of primary air ports 26 and 28 therethrough. A prechamber housing 30 is disposed within the outer liner 24 and includes a primary air passage 32 extending from the port 28 and a primary air passage 34 extending from the port 26. The prechamber housing 30 includes a generally cylindrical internal surface 36 having a circular upper end 38 and a circular lower end 40. A flame stabilization device or trip 42 having a central circular opening 44 therethrough is disposed at the lower end of the prechamber housing 30 so that communication is established through the prechamber housing from the plenum 12 to the reaction chamber 22.

Figure 2:
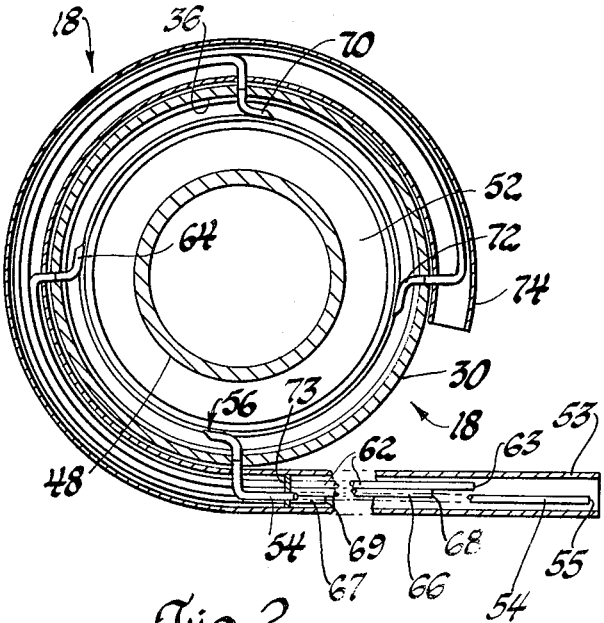
FIG. 2 is a sectional view taken generally along the plane indicated by lines 2—2 in FIG. 1.

As best seen in FIGS. 1 and 2, a plurality of swirler vanes 46 are rapidly attached to the prechamber housing 30 and project radially inward to a center body assembly 48. The center body assembly is rigidly attached to the gas turbine engine block by a support structure 50 and cooperates with the cylindrical surface 36 in defining a generally annular prechamber 52.

Figure 3:
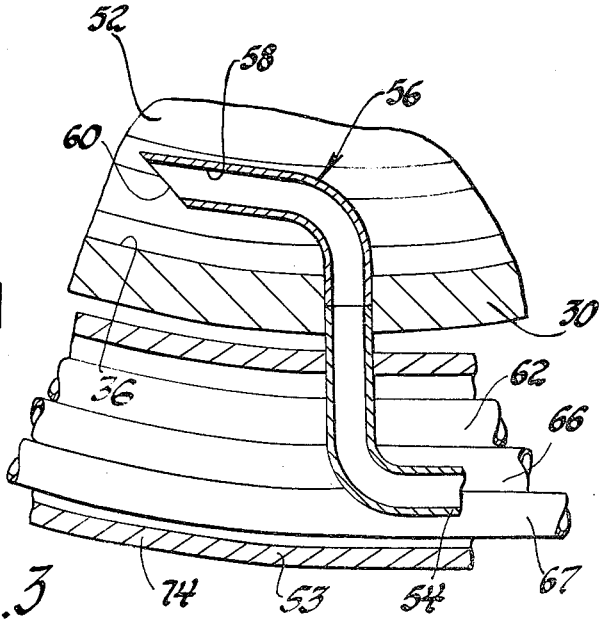
FIG. 3 is an enlarged view of a portion of FIG. 2 showing one of the plurality of fuel delivery heads.

With particular reference now to FIGS. 2 and 3, a main fuel supply pipe 53 extends from a relatively cool location remote from the premixing-prevaporization portion 18 and wraps generally three fourths of the way around prechamber housing 30 in a plane perpendicular to the longitudinal axis of the combustor. While for convenience the supply pipe has been illustrated wholly in the plane of the wrapped around portion, it will be understood that for reasons of space economy the pipe may curve into other planes. A first fuel conduit 54 is disposed within the pipe 53 and extends from an open end 55 to a first nozzle or fuel delivery head 56 disposed on the prechamber housing 30 and projecting into the prechamber 52. The delivery head 56 is supported on the prechamber housing 30 by conventional means and is connected to the end of fuel conduit 54 opposite open end 55, again by any conventional means. The delivery head 56 has a passage 58 therethrough extending from the conduit 54 to a fuel delivery port 60 generally adjacent the cylindrical surface 36. The delivery head 56 is curved so that fuel issuing from the delivery port 60 is directed tangent to the internal cylindrical surface 36. The cross sectional flow area of the port 60 generally equals the cross sectional flow area of the passage 58 which, in turn, generally equals the cross sectional flow area of the conduit 54.

Referring again to FIG. 2, a second fuel conduit 62 is disposed within the supply pipe 53 and extends between an open end 63 and a second delivery head 64 disposed on the prechamber housing 30 and projecting into the prechamber. Similarly, a third fuel conduit 66 and a fourth fuel conduit 67 are each disposed within supply pipe 53 and extend from respective open ends 68 and 69 to respective ones of a pair of delivery heads 70 and 72 disposed on the prechamber housing 30 and projecting into the prechamber. The second, third and fourth delivery heads 64, 70 and 72 are supported on the housing as described with respect to first delivery head 56 and are connected, respectively, to fuel conduits 62, 66 and 67 as described with respect to fuel conduit 54 and delivery head 56.

The fuel conduits 54, 62, 66 and 67 are of equal length and equal internal diameter which, in an automotive gas turbine application, may be on the order of between 0.007 and 0.020 inches. The supply pipe 53 accommodates all of the conduits and, again in the automotive gas turbine example, may be on the order of about 0.125 inches internal diameter. The interstices formed within supply pipe 53 between and around the fuel conduits is sealed in fuel tight manner, as by brazing, at a dam or wall 73 downstream of the open end 69 of fourth fuel delivery conduit 67. The volume within supply pipe 53 to the right, FIG. 2, of wall 73 is completely filled with fuel which enters open ends 55, 63, 68 and 69 of the fuel conduits and flows therethrough to delivery heads 56, 64, 70, and 72 respectively.

Describing now the operation of the improved prechamber and fuel manifold structure according to this invention, a conventional fuel control, not shown, functions, in a metering mode, to provide a steady supply of fuel at a preselected pressure to the supply pipe 53 to the right, FIG. 2, of wall 73 in accordance with engine power demand. The fuel control also includes a dump or purge valve, not shown, connected to a fuel reservoir at atmospheric pressure so that in a dump or purge mode of the fuel control residual fuel may be purged as described hereinafter. With respect, however, to the metering mode, fuel under pressure flows through the supply pipe to respective ones of open ends 55, 63, 68 and 69 of the fuel conduits and then through the conduits to the delivery heads. Since the fuel pressure in the supply pipe is the same at each open end and since the fuel conduits and passages 58 are of the same length and have internal diameters equal to each other and to the diameters of ports 60, equal quantities of fuel flow through and issue from the delivery heads generally tangent to the internal cylindrical surface 36. The fuel conduits are, therefore, essentially self metering and assure uniform fuel distribution around the prechamber 52 at even the very low delivery rates of automotive applications which may reach levels as low as one half pound per hour. As the fuel issues from the delivery heads it spreads across the internal cylindrical surface 36 under the influence of the swirling airstream moving from vanes 46 toward the reaction chamber 22. The flowing air causes the film of fuel on the internal cylindrical surface 36 to travel toward the reaction chamber 22 and, since the pressurized air is either heated regeneratively or heated by virtue of compression, the fuel film on the internal cylindrical surface 36 gradually mixes with and vaporizes in the swirling stream of air. The mixture of fuel and air then passes out of the prechamber 52, through the circular opening 44 in the trip 42 and into the reaction chamber 22 where combustion takes place either by virtue of the already existing flame in the reaction chamber or by virtue of the pilot flame tube assembly 20. The products of combustion, of course, are directed out of the reaction chamber by nozzle means, not shown.

At termination of engine operation, the fuel control commands a complete and abrupt cessation of fuel flow in the supply pipe 53 and, hence, in fuel conduits 54, 62, 66 and 67 and switches to the purge mode of operation. The engine's gasifier turbine and compressor continue rotating, although at decreasing speed, so that above-atmospheric pressure remains in the plenum 12, the prechamber 52 and the reaction chamber 22 even though combustion has terminated. In the purge mode, a dump or purge valve, not shown, between the supply pipe 53 and a fuel collection reservoir maintained at atmospheric pressure is opened. Accordingly, the elevated pressure existing in prechamber 52 at the termination of combustion forces fuel from the delivery heads back through the fuel conduits and into the supply pipe, the excess fuel being returned to the reservoir through the purge valve. Because the flow areas of the fuel conduits and the flow areas of the passages within the delivery heads are generally equal to the flow areas of the ports corresponding to port 60 in delivery head 56, the pressurized air effects complete evacuation of the fuel from all of the fuel conduits, at least up to wall 73, so that carbonization or coking of residual fuel in the fuel conduits at termination of combustion is foreclosed. Since the wall 73 is located remote from the hotter areas of the combustor, any residual fuel in the supply pipe 53 does not experience coking and need not be purged each time the engine is shut off.

The embodiments of the invention in which an exclusive property or privilege is claimed are defined as follows:

1. In a gas turbine engine having a pressurized air plenum, a combustor in said plenum, a source of fuel, a fuel control means remote from said combustor and connected to said fuel source, said fuel control means having a metering mode for metering fuel flow for combustion and a dump mode for purging fuel upon engine shut down to minimize fuel coking, and a generally cylindrical prechamber housing in said plenum defining a prechamber having an inlet exposed to said plenum and an outlet exposed to said combustor and a cylindrical surface therebetween, the improvement comprising, a plurality of delivery heads disposed on said prechamber housing with symmetrical spacing around said cylindrical surface and projecting therethrough into said prechamber, a plurality of identical fuel conduits in said plenum each having a first end and a second end and corresponding in number to the number of said delivery heads, means connecting said fuel conduit first ends to corresponding ones of said delivery heads, each of said fuel conduits wrapping around said prechamber housing and uniting with the others to form a bundle wherein said fuel conduit second ends terminate at successively greater distances from the end of said bundle, a fuel supply pipe having one end connected to said fuel control means and another end enveloping said fuel conduit bundle such that each of said fuel conduit second ends is disposed within said supply pipe, and means in said supply pipe defining a wall around said fuel conduit bundle downstream of the most distant of said fuel conduit second ends relative to the end of said fuel conduit bundle operative to prevent passage of fuel thereacross so that in said fuel control means metering mode equal fuel flow is induced in each of said fuel conduits and so that in said fuel control means dump mode fuel purge in each of said fuel conduits is rapid and complete.

2. The improvement recited in claim 1 wherein each of said fuel conduits has an internal diameter of between about 0.007 and 0.020 inches and wherein said fuel supply pipe has an internal diameter on the order of about 0.125 inches.

3. In a gas turbine engine having a pressurized air plenum, a combustor in said plenum, a source of fuel, a fuel control means remote from said combustor and connected to said fuel source, said fuel control means having a metering mode for metering fuel flow for combustion and a dump mode for purging fuel upon engine shut down to minimize fuel coking, a generally cylindrical prechamber housing in said plenum having a cylindrical wall disposed on a longitudinal axis of said combustor, and a center body projecting into said prechamber housing and cooperating with said cylindrical wall in defining an annular prechamber having an inlet exposed to said plenum and an outlet exposed to said combustor, the improvement comprising, a plurality of identical delivery heads disposed on said prechamber housing with symmetrical spacing around said cylindrical wall and projecting therethrough into said prechamber, each of said delivery heads having a flow port operative to direct a flow stream generally tangent to said cylindrical wall, a plurality of identical fuel conduits corresponding in number to the number of said delivery heads each having an internal diameter of between 0.007 and 0.020 inches and a first end and a second end, means connecting said fuel conduit first ends to corresponding ones of said delivery heads, each of said fuel conduits wrapping around said prechamber housing and uniting with the others to form a bundle wherein said fuel conduit second ends terminate at successively greater distances from the end of said bundle, a fuel supply pipe having an internal diameter of about 0.125 inches and one end connected to said fuel control means and another end enveloping said fuel conduit bundle such that each of said fuel conduit second ends is disposed within said supply pipe, and means in said supply pipe defining a wall around said fuel conduit bundle downstream of the most distant of said fuel conduit second ends relative to the end of said fuel conduit bundle operative to prevent passage of fuel thereacross so that in said fuel control means metering mode equal fuel flow is induced in each of said fuel conduits and so that in said fuel control means dump mode fuel purge in each of said fuel conduits is rapid and complete.

* * * * *